US006941788B2

(12) United States Patent
Goubaud

(10) Patent No.: US 6,941,788 B2
(45) Date of Patent: Sep. 13, 2005

(54) BENDING BRAKE FOR FLAT BLANK

(75) Inventor: Michel Goubaud, Saint Herblon (FR)

(73) Assignee: DIMOS, Ancenis (FR)

( * ) Notice: Subject to any disclaimer, the term of this patent is extended or adjusted under 35 U.S.C. 154(b) by 333 days.

(21) Appl. No.: 10/169,376

(22) PCT Filed: Jan. 5, 2001

(86) PCT No.: PCT/FR01/00029

§ 371 (c)(1),
(2), (4) Date: Nov. 15, 2002

(87) PCT Pub. No.: WO01/51274

PCT Pub. Date: Jul. 19, 2001

(65) Prior Publication Data

US 2003/0126904 A1 Jul. 10, 2003

(30) Foreign Application Priority Data

Jan. 14, 2000 (FR) ..... 00 00473

(51) Int. Cl.[7] ..... B21D 5/04
(52) U.S. Cl. ..... 72/319
(58) Field of Search ..... 72/319–321, 387, 72/388

(56) References Cited

U.S. PATENT DOCUMENTS

| | | | | | |
|---|---|---|---|---|---|
| 3,380,280 | A | * | 4/1968 | Wise | 72/319 |
| 4,111,027 | A | * | 9/1978 | Bottomley | 72/320 |
| 4,282,735 | A | | 8/1981 | Break | 72/319 |
| 4,493,200 | A | * | 1/1985 | Rhoades | 72/319 |
| 4,558,582 | A | * | 12/1985 | Meinig | 72/381 |

* cited by examiner

*Primary Examiner*—Daniel C. Crane
(74) *Attorney, Agent, or Firm*—Young & Thompson

(57) ABSTRACT

The invention concerns a brake (1) comprising at least a platen (2) co-operating with a press (3) for immobilizing a blank section to be bent, the platen (2) being extended by a table (4) hinged to the platen (2) via a hinge. The brake (1) is characterized in that part of the hinge consists of a cage having in transverse section a profile with a cylindrical segment (6B) prolonged by a retaining lip (6C) defining with the segment an opening (6D) of the cage (6A), the cage (6A) being designed to receive by simple sliding the other hinge part, the hinge part having a generally winding conchoidal shape exhibiting in transverse section a profile with a cylindrical segment prolonged by a retaining lip. The invention is useful for bending blanks.

6 Claims, 7 Drawing Sheets

BENDING BRAKE FOR FLAT BLANK

This application is a 371 of PCT/FR01/00029, filed Jan. 5, 2001.

The present invention relates to a brake particularly to form, on a flat blank such as a thin sheet or a sheet metal, sections of angular orientation selected by the operator.

It relates more particularly to a brake of the type comprising at least one platen coacting with a press to immobilize a section of the blank to be bent, the platen being prolonged by a table articulated to the platen by means of a hinge to thereby angularly to orient, by relative displacement of the table and the platen, the angular section immobilized relative to the rest of the blank.

There exist two categories of brakes.

In the first category of brakes, the platen and the press between which is immobilized a section of blank, are stationary in the course of a bending operation, whilst the table is pivotally driven about a pivotal axis passing through the hinge connecting the table to the platen.

In the second category of brake, the table remains on the contrary stationary in the course of the bending operation. The platen and the press between which is immobilized a section of blank, are thus driven to pivot about a pivotal axis passing through the hinge connecting the table to the platen.

These two types of brake have the same drawback, namely, a complicated hinge that is generally undismountable, which gives rise to the immobilization of the brake in the case of deterioration of the hinge.

An attempt to provide an easily dismountable hinge has nevertheless been described in U.S. Pat. No. 4,282,735. In this patent, the platen of the brake comprises a cylindrical sector prolonged internally by a projection that plays the role of a stationary pivotal axis about which turns the portion of the hinge that is secured to the table. In the course of this rotative movement of the hinge portion secured to the table of the brake, the latter reaches a position in which the forces exerted on the hinge under the action of bending sheet metal tend to deform this hinge portion, as shown in FIG. 10 of the patent, such that a hinge of this type deteriorates with time. It has thus been noted that, upon a deformation of at least one portion of the hinge, the latter tends to disengage from the hinge, thereby preventing any operation of this latter. Moreover, such a hinge design requires leaving a substantial distance between the bending axis and the axis of articulation of the hinge, which impedes the operation of the brake.

An object of the present invention is thus to provide a brake whose hinge connecting the table to the platen, is a simple design and can be easily mounted or dismounted, this hinge being undeformable.

Another object of the present invention is to provide a brake whose hinge connecting the table to the platen can be provided simultaneously with the table or respectively the platen without requiring the use of supplemental pieces.

To this end, the invention has for its object a brake particularly to form, on a flat blank such as sheet metal or a thin sheet, sections of any angular orientation, this brake comprising at least one platen coacting with a press to immobilize a section of the blank to be bent, the platen being prolonged by a table articulated to the platen by means of a hinge to orient angularly, by relative movement of the table and the platen, the angular section of the blank immobilized relative to the rest of the blank, said hinge being constituted of two hinge portions belonging respectively one to the table, the other to the platen, characterized in that the female portion of the hinge, preferably secured to the platen, is constituted by a cage having a transverse cross section in the shape of a cylindrical sector prolonged by a retaining lip delimiting with said cylindrical sector an opening of the cage, said cage being adapted to receive by simple sliding the other male portion of the hinge, preferably secured to the table, this male portion of the hinge having a generally winding conchoidal shape, with a transverse cross sectional shape in the form of a cylindrical sector prolonged by a retaining lip such that, in the assembled condition, the hinge portions will be maintained in engagement at least by their respective retaining lips, the distal end of the retaining lip taking part in the conchoidal winding having a cross section inscribed in a circle to constitute a pivotal axis in the assembled condition of the two portions of the hinge, this retaining lip of the conchoidal winding being maintained in bearing contact with the interior of the cage against the retaining lip of said cage whilst the cylindrical sector of the conchoidal winding permanently bears against the retaining lip of the cage and against the cylindrical sector of the cage, these three points of bearing being simultaneously in continuous contact no matter what the angular position of the constituent parts of the hinge.

Thanks to this new design of this hinge which ensures permanent bearing at three points, of the hinge portions against each other, any risk of deformation of the hinge in the course of its operation is avoided. Moreover, the design of the hinge permits maintaining a constant small distance between the bending axis of the brake and the axis of articulation of the hinge so as to obtain optimum operation of the brake.

The invention will be better understood from a reading of the following description of examples of embodiment, with reference to the accompanying drawings, in which.

Figure 1:
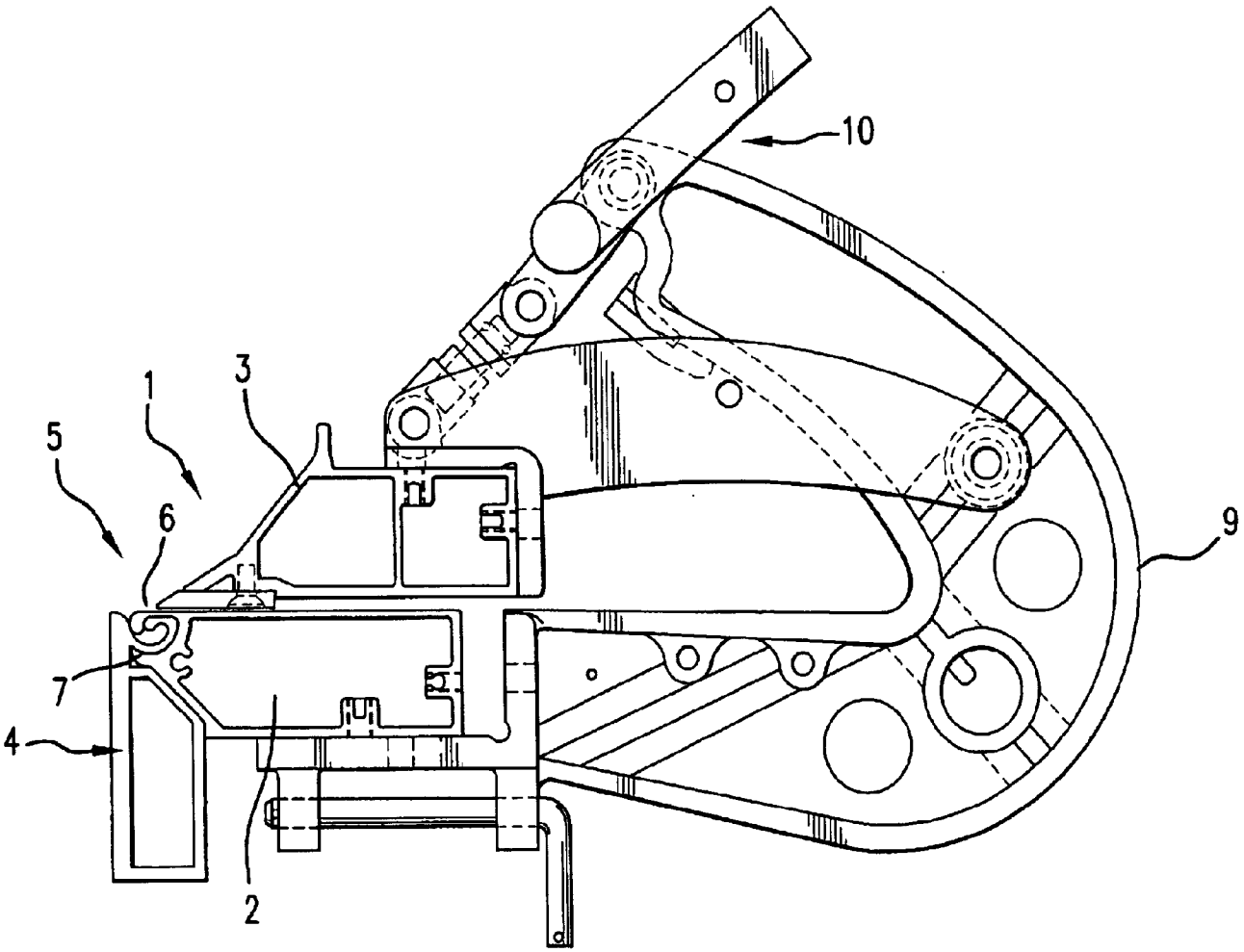
FIG. 1 is a transverse cross sectional view of a first embodiment of a brake according to the invention.

The brake, shown generally by reference numeral 1, according to the invention, is more particularly adapted for bending flat blanks, such as thin sheets, generally metallic, metal sheets sufficiently rigid to retain, after bending, the angular orientation given to each cross section of the blank.

Figure 4:
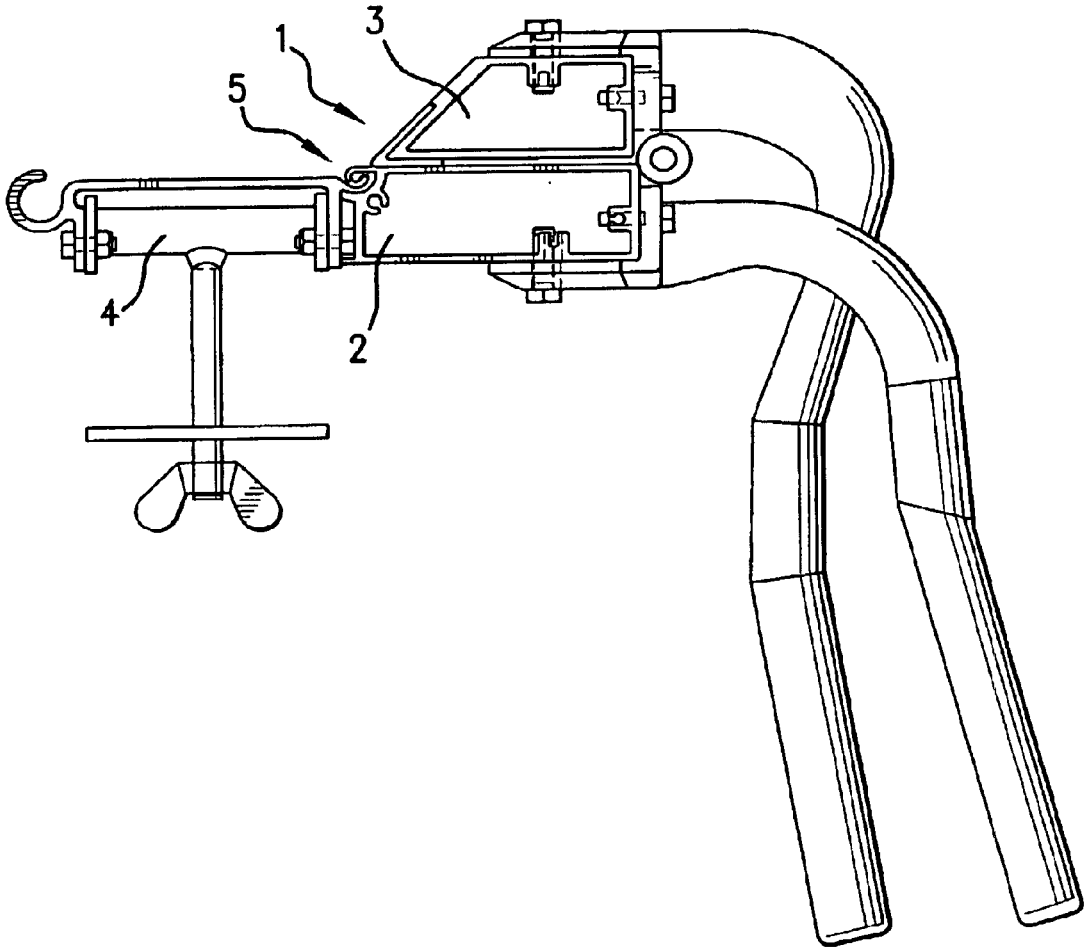
FIG. 4 is a transverse cross sectional view of another embodiment of a brake according to the invention.
Figure 5:
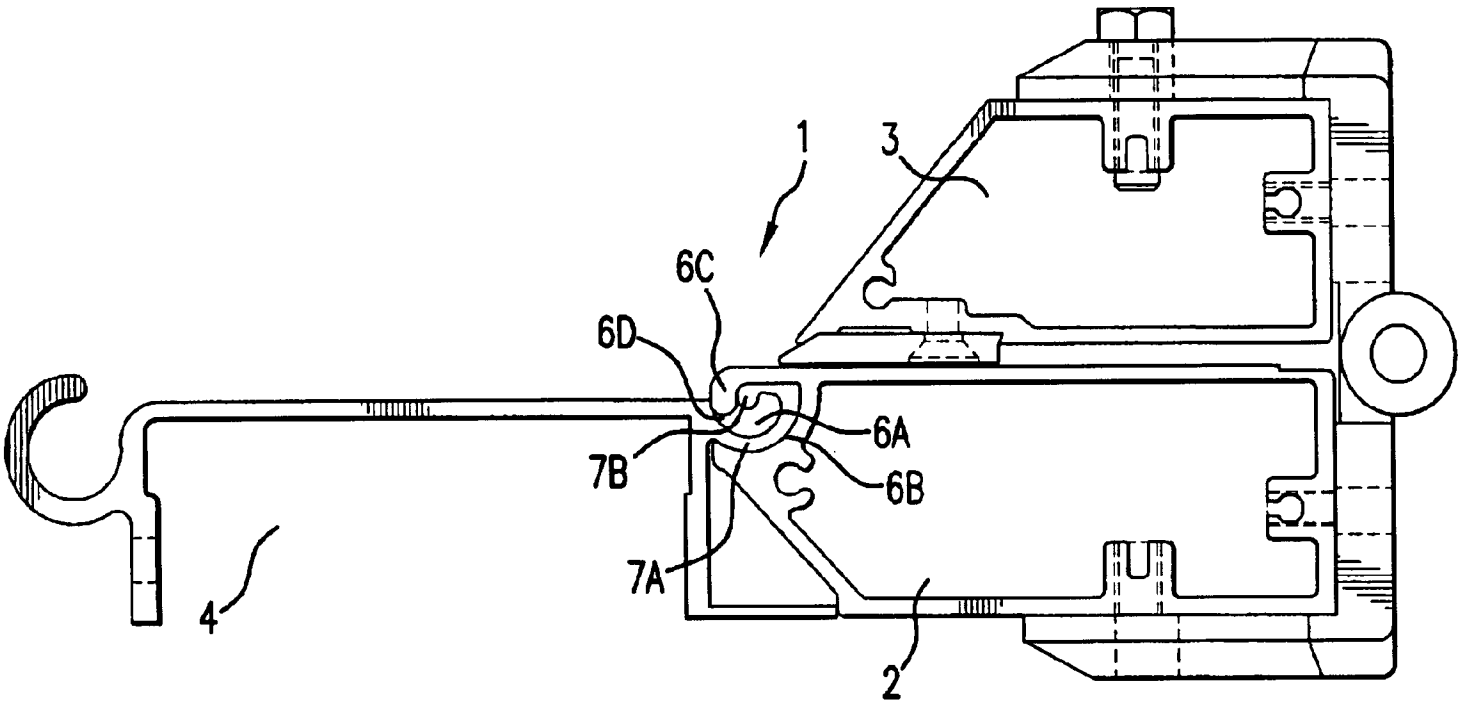
FIG. 5 is a view in transverse cross section of the brake shown in FIG. 4.
Figure 6:
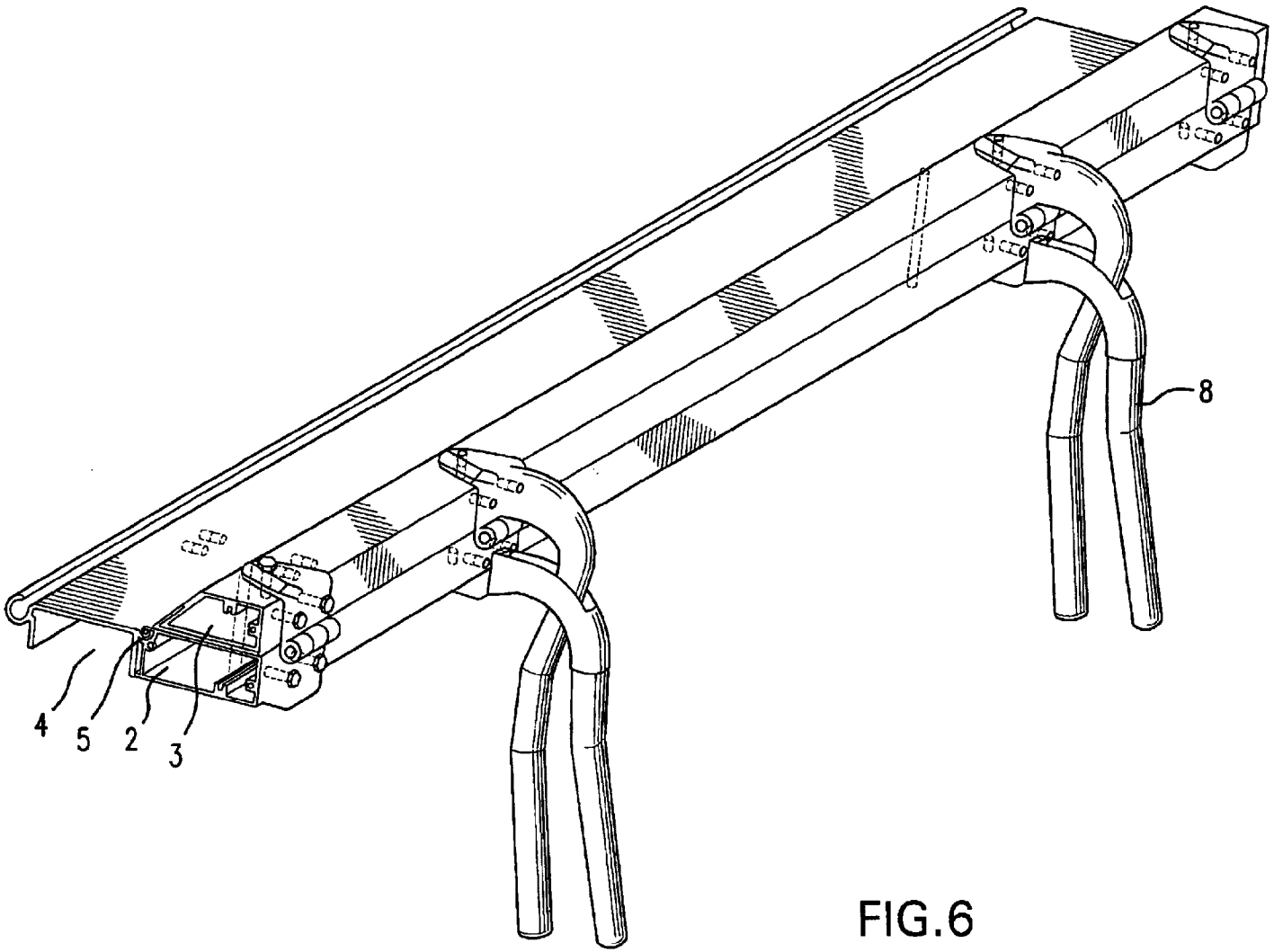
FIG. 6 is a fragmentary perspective view of the brake shown in FIGS. 4 and 5.
Figure 7:
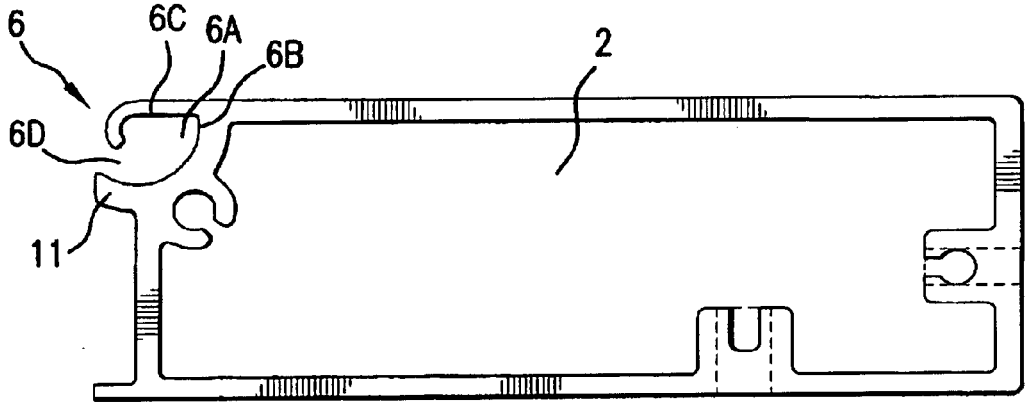
FIG. 7 is a transverse cross sectional view of the constituent profile of the platen of the brake shown in FIGS. 4 to 6 and FIG. 8 is a transverse cross sectional view of the profile constituting the table of the brake shown in FIGS. 4 to 6.
Figure 8:
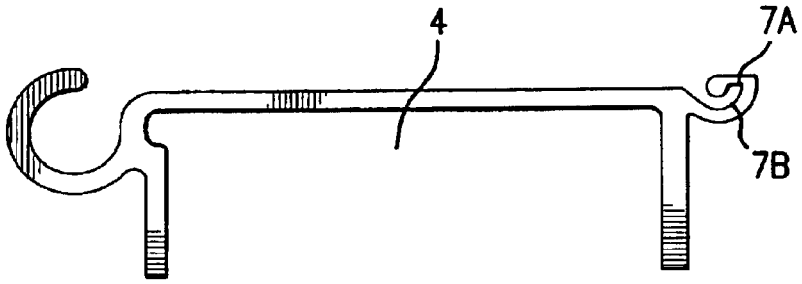

This brake 1 comprises, in a manner known per se, at least one platen 2 coacting with a press 3 to immobilize a section of the blank to be bent. The immobilization can be carried out by means of handles 8 as shown in FIGS. 4 to 6, these handles 8 being held close together by the hand of the operator. This immobilization can also be obtained by means of a joint 9 coacting with a swan's neck 10 to hold the press 3 and the platen 2 in a condition applied against each other. These means will not be described in greater detail hereafter because they are well known to those skilled in the art.

The platen 2 is articulated to a table 4 by means of a hinge shown generally at 5. This articulation permits, by relative movement of the table 4 and the platen 2, giving to the immobilized angular cross section of the blank an angular orientation predetermined by the user relative to the rest of the blank.

Figure 2:
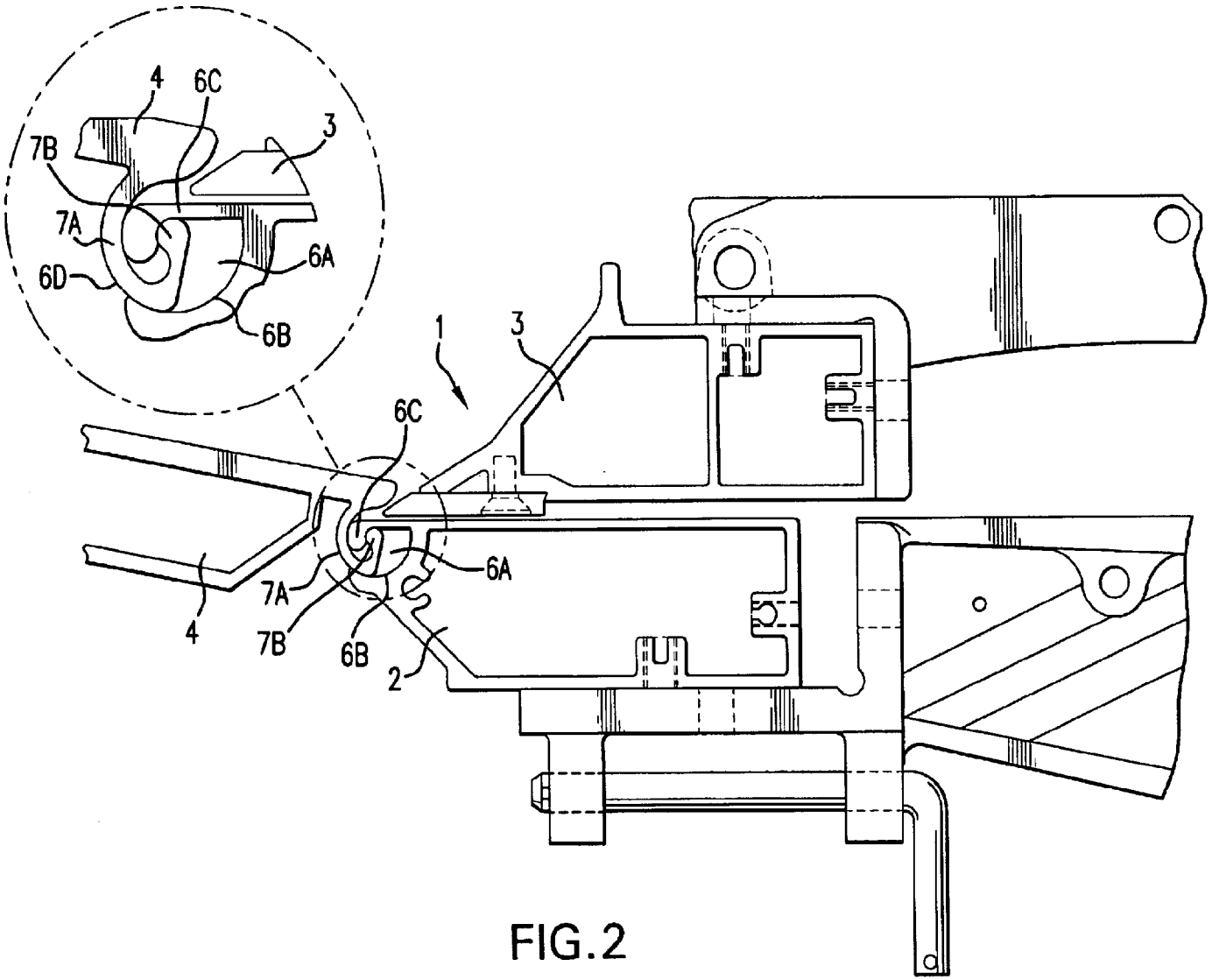
FIG. 2 is a transverse cross sectional view of the brake of FIG. 1 in the course of a bending operation, the detail of the hinge being shown enlarged.
Figure 3:
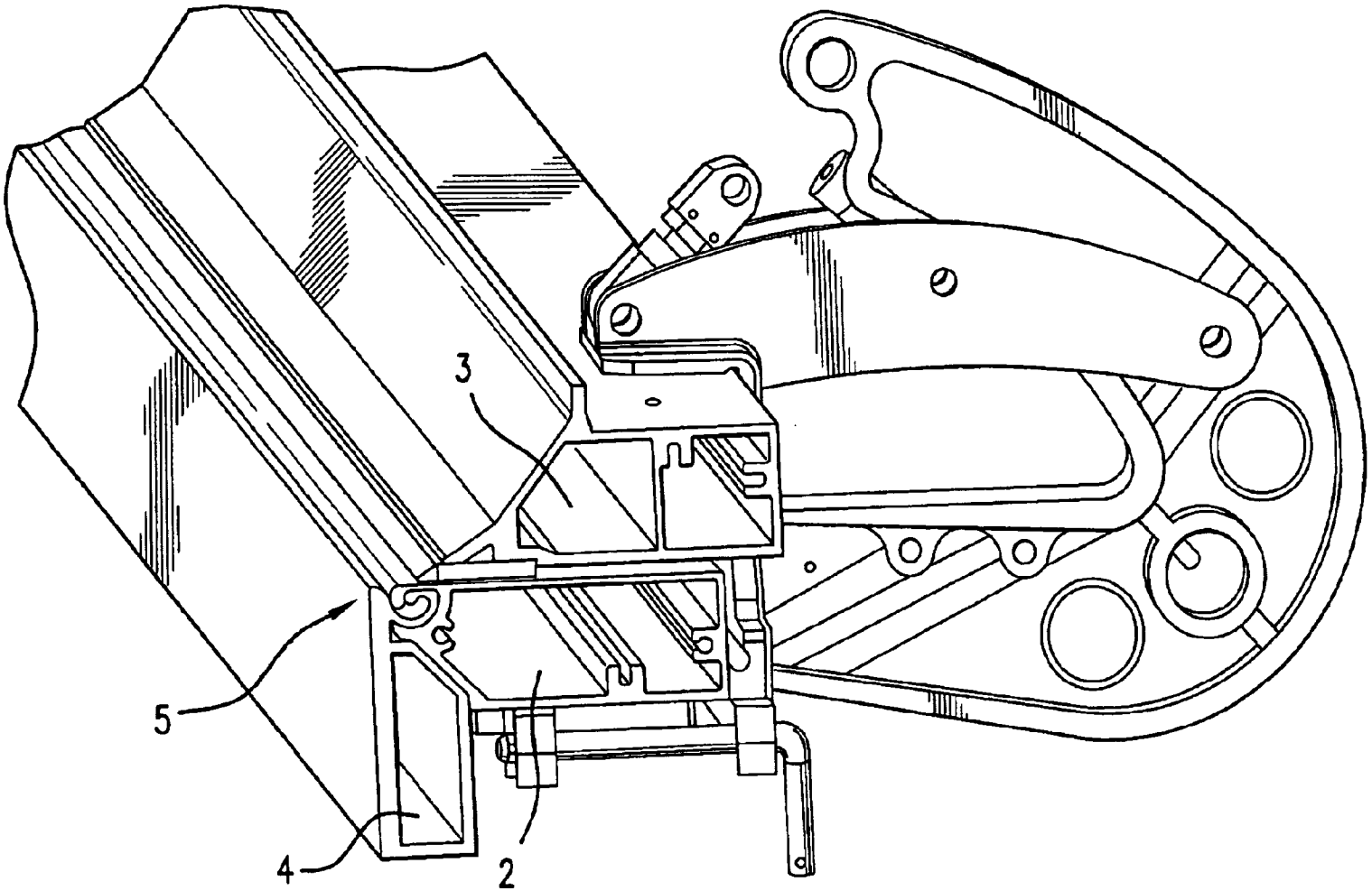
FIG. 3 is a partial perspective view of the brake of FIG. 1.

In a first category of brakes, according to that shown in FIGS. 1 to 3, the platen 2 and the press 3 are held stationary during the bending operation whilst the table 4 is driven to pivot about a pivotal axis passing through the axis of the hinge, as shown in FIGS. 1 and 2. Conversely, in FIGS. 4 to 6, the table 4 is held stationary whilst the platen 2 and the press 3 are driven pivotally about a pivotal axis passing through the axis of hinge 5. The design of the hinge 5, as will be described hereafter, can thus be used in either one of the two categories of brakes described above.

This hinge 5 is constituted by two hinge parts belonging respectively and as desired, one to the table 4, the other to the platen 2. In the illustrated examples, the female hinge portion belonging to the platen 2 is shown at 6 whilst the male portion of the hinge belonging to the table 4 is shown at 7. A hinge portion, in this case the female portion 6 of the hinge belonging to the platen 2, is constituted by a cage 6A having a transverse cross section in profile of cylindrical sector 6B prolonged with a retaining lip 6C. The retaining lip 6C delimits with the cylindrical sector 6B an opening 6D of the cage 6A. The other male portion 7 of the hinge belonging to the table 4 has the general shape of a conchoidal winding. This portion 7 of the hinge has in transverse cross section a profile in the shape of a cylindrical sector 7A prolonged by a retaining lip 7B. The hinge portions 6 and 7 are assembled by simple sliding of the male portion 7 of the hinge of generally conchoidal winding shape, in the cage 6A constituting the female portion 6 of the hinge. The cage 6A, of generally elongated shape, is thus open at at least one of its ends to permit sliding introduction of the other portion 7 of the hinge into said cage. The results amount a particularly easy mounting and unmounting of said hinge without requiring making supplemental connections or having complementary securement members. The hinge portions 6 and 7 are thus held in engagement at least by their respective retaining lips.

In the illustrated embodiments, the female portion 6 of the hinge 5 constituted by a cage 6A is secured to the platen 2. However, this portion 6 of the hinge 5 could also be secured to the table 4 without departing from the scope of the invention.

The hinge portions 7 and 6 are preferably respectively made of one piece with the table 4 and the platen 2. To facilitate this one-piece construction, preferably, the platen 2 and the table 4 have respectively the shape of a beam, such as an extrusion. The construction in profiled shape thus permits, without difficulty, producing in a single piece a hinge portion and respectively the platen or the table. Each hinge portion 6, 7 is thus arranged respectively adjacent an angle of the beam. Thus, the female hinge portion constituted by a cage is generally arranged behind said angle whilst the male hinge portion in the form of a conchoidal winding is arranged projecting from said beam angle. Moreover, at least one surface of each beam takes part in the guidance of the other beam during sliding introduction of one hinge portion into the other hinge portion.

In each illustrated embodiment, the distal end of the retaining lip 7B taking part in the conchoidal winding has a cross section inscribed in a circle to constitute a pivotal axis in the assembled condition of the two hinge portions 6, 7. This retaining lip 7B is held in bearing contact with the interior of the cage 6A against the retaining lip 6C of the cage. In the embodiments illustrated in FIGS. 1 to 3, the distal end of the retaining lip 7B taking part in the conchoidal winding constitutes a pivotal axis turning on itself during operation of the hinge and held in bearing contact pivoting within the cage against the retaining lip 6C of the cage.

Similarly, in each illustrated embodiment, the cylindrical sector 7A of the conchoidal winding is in permanent bearing relation against the retaining lip 6C of the cage 6A and against the cylindrical sector 6B of the cage 6A. Because of this, no matter what the angular position of the constituent parts of the hinge, this hinge will have simultaneously and permanently at least three points of bearing contact between said hinge portions. It is to be noted that in the illustrated examples, the internal surface of the cylindrical sector 7A of the conchoidal winding bears against the external surface of the retaining lip 6C of the cage 6A whilst the external surface of this cylindrical sector 7A bears against the internal surface of the cylindrical sector 6B of the cage 6A.

Finally, in the two illustrated embodiments of brakes, the cylindrical sector 6B of the cage 6A of the female portion 6 of the hinge belonging to the platen 2 is prolonged by an abutment 11 adapted to bear against a portion of the table 4 to guarantee initial relative positioning of the table 4 and the platen 2 which will always be identical. Thus, in the examples shown in FIGS. 1 to 3, said abutment will be disposed in the space left free between the hinge portion in the form of a conchoidal winding and the rest of the beam constituting the table 4, this space having substantially the shape of a groove for receiving said abutment.

In the examples shown in FIGS. 4 to 6, the cylindrical sector of the cage of the hinge portion belonging to the platen 2 is prolonged by an abutment adapted to bear against the face of the table 4 to guarantee horizontality of the table 4 and of the platen 2, particularly during introduction into the press 3 of a sheet to be bent.

The principle of operation of such a brake is particularly simple. It will be merely recalled that a blank to be bent is introduced between the press 3 and the platen 2. This section of blank is immobilized between platen 2 and press 3 by means of the handles 8 or of the joint 9. Once the section is immobilized, the table 4 or respectively the assembly of platen 2 and press 3 is driven pivotally about the pivotal axis constituted by the hinge 5 to an angular position which is a function of the bending operation to be carried out. In the case of FIGS. 1 and 2, once the operation of bending has been completed, the table 4 is returned to its initial position corresponding to a substantially vertical position, under the influence of its own weight. The blank can then be withdrawn from the assembly of press 3—platen 2. In the case of the press shown in FIGS. 4 to 6, once the blank is bent, the handles are spaced from each in the selected angular orientation to permit release of the blank, then the assembly of platen 2-table 3 is returned to its initial position.

What is claimed is:

1. Brake (1) to form, on a flat blank or a thin sheet, sections of any angular orientation, this brake (1) comprising at least one platen (2) coacting with a press (3) to immobilize a section of the blank to be bent, the platen (2) being prolonged by a table (4) articulated to the platen (2) by means of a hinge (5) to orient angularly, by relative movement of the table (4) and of the platen (2), the immobilized angular section of the blank relative to the rest of the blank, said hinge (5) being constituted by two hinge parts belonging respectively one to the table (4), the other to the platen (2), characterized in that a female hinge portion (6), secured to the platen (2), is constituted by a cage (6A) having as its transverse cross section a profile in the shape of a cylindrical sector (6B) prolonged by a retaining lip (6C) delimiting with said cylindrical sector (6B) an opening (6D) of the cage (6A), said cage (6A) being adapted to receive by simple sliding a male portion (7) of the hinge (5), this male portion (7) of the hinge (5) in the general shape of a conchoidal winding, having in transverse cross section a profile in the shape of a cylindrical sector (7A) prolonged by a retaining lip (7B) such that, in the assembled condition, the portions (6, 7) of the hinge (5) will be held in engagement at least by their respective retaining lips (6C, 7B), the distal end of the last-named retaining lip (7B) taking part in the conchoidal winding having a cross section inscribed in a circle to constitute a pivotal axis in the assembled condition of the two portions (6, 7) of the hinge (5), this last-named retaining lip (7B) of the conchoidal winding being held in bearing contact within the cage (6A) against the first-named retaining lip (6C) in a manner such that the cylindrical sector (7A) of the conchoidal winding bears permanently against the retaining lip (6C) of the cage (6A) and against the cylindrical sector (6B) of the cage (6A), these three points of bearing being simultaneously in permanent contact no matter what the angular position of the constituent parts of the hinge.

2. Brake (1) according to claim 1, characterized in that the distal end of said last-named retaining lip (7B) taking part in the conchoidal winding of the male portion (7) of the hinge is constituted by a pivotal axis turning on itself during operation of the hinge and is held continuously in pivoting bearing contact against the retaining lip (6C) of the cage (6A).

3. Brake (1) according to claim 1, characterized in that the platen (2) and the table (4) have respectively the shape of a beam, each portion (6, 7) of the hinge (5) being provided respectively adjacent a corner of a beam.

4. Brake (1) according to claim 1, characterized in that the portions (6, 7) of the hinge (5) are respectively made of one piece with the platen (2) and the table (4).

5. Brake (1) according to claim 1, characterized in that the cylindrical sector (6B) of the cage (6A) of the female portion (6) of the hinge belonging to the platen (2) is prolonged by an abutment adapted to bear against a portion of the table (4) to guarantee an initial relative positioning of the table (4) and of the platen (2) which will always be the same.

6. Brake (1) according to claim 5, characterized in that the cylindrical sector (6B) of the cage (6A) of the female portion (6) of the hinge belonging to the platen (2) is prolonged by an abutment adapted to bear against the face of the table (4) to guarantee the horizontality of the table (4) and of the platen (2).

* * * * *